United States Patent [19]

Neale et al.

[11] 4,105,225

[45] Aug. 8, 1978

[54] AUTOGRAPHIC REGISTER SYSTEMS

[75] Inventors: David John Neale, Waltham Cross; Victor Herbert Perriman, London, both of England

[73] Assignee: Moore Business Forms Inc., Niagara Falls, N.Y.

[21] Appl. No.: 603,094

[22] Filed: Aug. 8, 1975

Related U.S. Application Data

[63] Continuation of Ser. No. 538,040, Jan. 2, 1975, abandoned.

[30] Foreign Application Priority Data

Jan. 10, 1974 [GB] United Kingdom ..... 1194/74
Dec. 13, 1974 [GB] United Kingdom ..... 53901/74

[51] Int. Cl.[2] ..... B41M 5/22

[52] U.S. Cl. ..... 282/27.5; 400/1; 400/61; 400/76; 427/150; 428/307; 428/511; 428/535; 428/536; 428/914

[58] Field of Search ..... 282/27.5; 427/150, 151, 427/153; 428/914, 307, 320, 507, 508, 510, 511, 514, 535, 536, 537; 197/DIG. 5

[56] References Cited

U.S. PATENT DOCUMENTS

| | | | |
|---|---|---|---|
| 3,020,170 | 2/1962 | Macaulay | 117/36.1 |
| 3,111,421 | 11/1963 | Newman et al. | 427/153 X |
| 3,328,190 | 6/1967 | Mathieu | 428/914 X |
| 3,672,935 | 6/1972 | Miller et al. | 117/36.8 |
| 3,684,549 | 8/1972 | Shank | 117/36.2 |
| 3,689,301 | 9/1972 | Scott | 428/914 X |
| 3,793,075 | 2/1974 | Maalouf | 282/27.5 |

FOREIGN PATENT DOCUMENTS

| | | | |
|---|---|---|---|
| 840,673 | 7/1960 | United Kingdom. | |
| 941,549 | 11/1963 | United Kingdom | 427/153 |
| 1,242,740 | 8/1971 | United Kingdom | 427/153 |
| 1,367,887 | 9/1974 | United Kingdom | 427/144 |

*Primary Examiner*—George F. Lesmes
*Assistant Examiner*—Bruce H. Hess
*Attorney, Agent, or Firm*—Watson, Cole, Grindle & Watson

[57] ABSTRACT

A transfer sheet of a transfer sheet assembly for use in an Autographic Register System has a coating which embodies a colorless color former. The coating is porous and the colorless color former is retained in the pores of the coating unitl autographic writing is applied to the uppermost record web of the assembly whereby the colorless color former is squeezed out of the coating onto the upper face of the next record web of the assembly. The record webs of the assembly have a developing receptive nature to develop the color of the squeezed out color former. The area of development corresponds to the autographic writing applied to the uppermost sheet.

2 Claims, 1 Drawing Figure

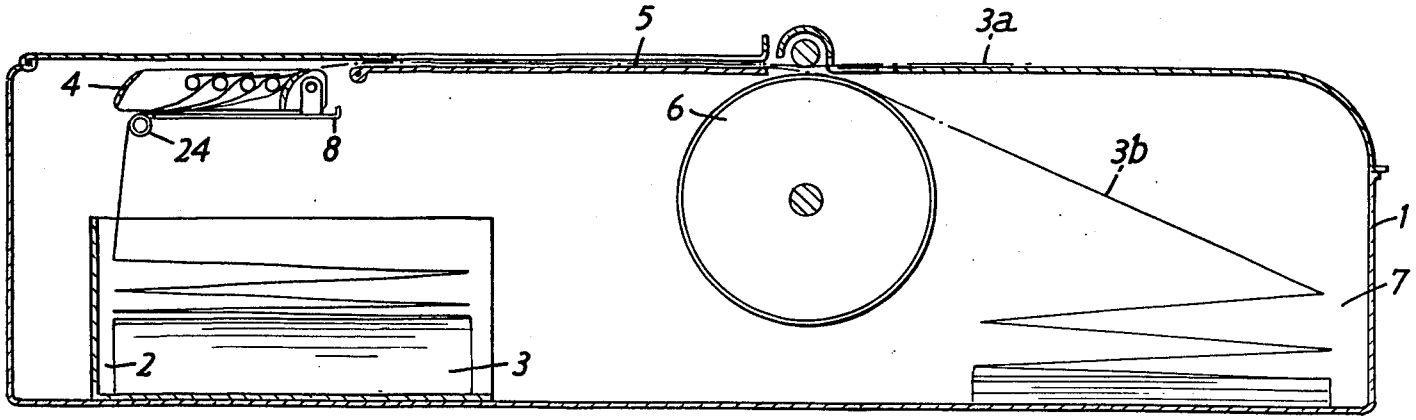
1
7
3b
3a
6
5
3
8
24
2
4

AUTOGRAPHIC REGISTER SYSTEMS

This is a continuation of copending application Ser. No. 538,040, filed Jan. 2, 1975, now abandoned.

This invention has reference to transfer sheet assemblies for use in autographic register systems and to autographic register systems embodying such transfer sheet assemblies.

Autographic registers have been marketed for many years. The registers comprise a casing including a compartment to receive a pack of folded interleaved continuous stationary webs with means to feed the continuous stationery webs through the autographic register. The continuous stationery webs consists of uppermost web and one or more underlying copy part webs. The webs are fed over a writing plate whereat data is written by hand on the uppermost of the continuous stationery webs and the data is duplicated on the underlying parts of the continuous stationery assembly by virtue of transfer webs or sheets (usually of carbon paper) interleaved with the continuous stationery webs. When data has been applied to the webs a handle at one side of the machine is operated whereby one form length of web is fed out of the register and the other part webs are fed into a filing compartment where the webs to be filed are refolded and stored.

In such autographic registers the interleaved carbon paper sheets or webs are sometimes fed transversely to the direction of feed of the continuous stationery webs or the transfer sheets may be retained stationary within the autographic register and when a pre-determined number of writings have been effected the carbon sheets are renewed. Whenever a new pack of continuous stationery webs is loaded into the autographic register the continuous stationery webs have to be interleaved with the carbon webs or sheets and this is a dirty job for the operator. Likewise when a new set of carbon sheets or webs have to be inserted into the machine this is also a dirty job for the operator.

This invention also has reference to these Autographic Registers sometimes known as Portable Registers or Pocket Registers. Generally these Portable or Pocket Registers comprise a casing including a compartment and a plate. In these kind of Registers the continuous stationery webs are pulled by hand by the operator over the writing plate and the file copy webs are inserted by hand into a filing compartment in the Register. Such registers also embody one or more transfer sheets either in the form of transfer webs pulled through the autographic register by hand or in the form of replaceable single form length sheets.

It is also known to provide transfer sheets sometimes referred to as 'solvent carbon' sheets which consist of a base sheet to which is applied a layer of a porous material with the pores of the material containing coloured ink which coloured ink is squeezed out of the porous layer when pressure is exerted on it as by a writing implement or a typewriter. Examples of such transfer sheets are described in British patent specification Nos. 392220, 780492 and 840673.

It is additionally known to provide a transfer sheet comprising a base sheet and transfer material coated thereon said transfer material containing a colourless colour precursor which on being interleaved with record webs and having pressure applied to the top web of the record webs in parts thereof in the form of an autographic mark such mark is reproduced on the underlying record webs by transfer of selected portions of transfer material including the colourless colour precursor and the sheets embodying the transferred selected portions are then used in a solvent duplicator process which includes the development of the colourless colour precursor. Such transfer sheets are described in British patent specification No. 1367887.

It is an object of the present invention to provide an improved transfer sheet for use in autographic register systems.

It is another object of the present invention to provide a clean autographic register system whereby the operator does not get her hands soiled when inserting a new continous stationary web assembly into the register or when the inserting new transfer sheets or webs into the autographic register.

It is a still further object of the present invention to provide a clean to handle transfer sheet of the 'solvent carbon' type.

According to one aspect of the present invention a transfer sheet assembly for use in an autographic register system comprises a plurality of record webs of continuous stationery which are adapted to be fed through an autographic register, which webs are interleaved with transfer material containing a colourless colour former but which on pressure being applied to the uppermost record web to produce an autographic mark on the said uppermost web such mark is reproduced on the underlying record webs by transfer of transfer material including the colourless colour former which on being received from the under face of one of the transfer sheets by the upper face of the adjacent underlying web, the material of the upper face develops the colourless colour former to show a copy of the mark on the underlying web.

According to another aspect of the present invention a transfer sheet comprises a base sheet, a porous coating applied to the base sheet and a colourless colour former contained within the pores of the porous coating which on being subjected to pressure in contact with a receptor sheet, selective transfer of the colour former is effected onto the receptor sheet to develop a coloured mark at those parts of the coating subjected to pressure.

According to a still further aspect of the present invention a method of producing a copy of an autographic mark or marks in an autographic register comprises interleaving a plurality of record webs of continuous stationery with alternate transfer sheets containing a colourless colour former and applying pressure to the uppermost record web to produce an autographic mark on the uppermost record web and said pressure being applied to the underlying webs and sheets to effect transfer of transfer material including the colourless colour former from the record sheets to the underlying record web whereby said colourless colour former is received by the record web and the material of the upper face of the record web develops the colourless colour former transferred to show a copy of the autographic mark on the underlying web.

An autographic register system and transfer sheet system therefor in accordance with the present invention will now be described by way of example, with reference to the accompanying drawings which diagrammatically shows an autographic register.

Referring to the FIGURE there is shown an autographic register 1, having a filing compartment 2, for housing a pack of interleaved continuous autographic register webs 3. The webs are fed through a tension unit or grid 4, from the writing table 5 by feed means represented diagrammatically at 6. Webs of transfer paper are fed transversely across the writing table to provide for the recording of information on the lower webs corresponding to the information recorded on the uppermost web. The uppermost web 3*a* is fed out of the autographic register while the lowermost web at webs 3*b* are fed to a security compartment within the register where they are re-folded in a pack for filing and stock control purposes.

In a system as shown in the drawings the transfer paper is fed in incremental movements from a housing on one side of the autographic register across the writing table to another respective housing on the other side. Alternatively the transfer paper is pulled manually across the writing table through a releasable clamping device so arranged that the used up paper can be torn off and disposed of.

The transfer papers are interleaved with the record webs of continuous stationery with the continuous stationery being arranged on the top and bottom webs of the assembly with the transfer webs arranged alternatively with the continuous stationery webs. It is preferred that the transfer sheets shall have a paper base to facilitate tearing off when used.

By the present invention we include in the transfer paper a coating containing a colourless colour former which on being subjected to the application of pressure by a writing instrument such as a ball point pen brings the colour former into pressurised contact with part of the record web which constitutes a receptor sheet over an area representing a character whereby over the area of contact a chemical reaction takes place between the transferred colourless colour former in the transfer paper and a reactive component of the receptor sheet to reproduce on the receptor sheet a representation of the character. Preferably the transfer paper is of the kind sometimes known as "solvent carbon" paper which has a base sheet and a coating with a porous structure, namely having a plurality of pores with some degree of interconnection and the pores contain a colourless colour former in solution or suspension, which colour former is squeezed out of the porous structure into contact with the record sheet over those areas of the record sheet to which pressure had been applied (probably in the form of a number of other characters). The colourless colour former then comes into selective contact with the record web adjacent to it and this record web has a coating such as the colourless colour former will be subjected to a colour developing reaction so that a representation of the number of other character is reproduced on the record web.

A transfer sheet, preferably in the form of a roll interleaved with other similar sheets, may be made according to the following examples:

EXAMPLE 1

| TRANSFER LAYER | | lbs | ozs |
|---|---|---|---|
| Part 1 | | | |
| | Tri xylyl Phosphate | 15 | 0 |
| | Phenyl leucauramine (re-crystallised) | 0 | 10½ |
| Part 2 | | | |
| | Water | 26 | 4 |
| | Silver Stream Gelatin E/200/A (ex Alfred Adams & Co. Ltd.) | 8 | 4 |
| | Precipitated Calcium Carbonate | 6 | 6 |
| | Titanium Dioxide-Rutile grade | 1 | 8 |
| | Soda Ash | 0 | 6 |
| | Water | 3 | 0 |
| | Perminal EML 10% aqueous solution (ex ICI Ltd) | 1 | 8 |
| | Mycocide DG 10% Aqueous solution | 0 | 0¼ |
| | Teepol (ex Shell) | 0 | 5½ |
| | | 53 | 4¼ |

Prepare Part 1 by dissolving phenyl leucauramine in the trixylyl phosphate at about 70° C. Prepare Part 2 by adding the premixed gelatin, precipitated calcium carbonate and titanium dioxide to the water at about 60° C with stirring. Then add the soda ash solution, perminal EML solution and nycocide DG with stirring. Add part 1 with stirring at about 60° C and stir to a droplet size of 5 - 10 and finally add the teepol solution.

Paper coating

Two coats of an ethyl cellulose barrier coating (at a coated weight of 3 g.s.m. each) are required before application of the Gelatin Emulsion on to paper i.e. White Karbalo 50% rag 24.5 grams per square meter fom Brittains Limited. Also a backing is required on the reverse side at a coated weight of 7 - 8 g.s.m. to prevent curl and prevent static forming on the sheet and prevent bleed. The Gelatin Emulsion is applied at a coated weight of 18.5 g.s.m. after barrier coating.

| Barrier Coating Formula | lbs. | ozs. |
|---|---|---|
| Ethyl Cellulose N 10LV (ex Hercules) | 6 | 0 |
| 64 O.P. Methylated Spirits | 60 | 0 |
| Precipitated Calcium Carbonate | 12 | 0 |
| Titanium Dioxide (Rutile grade) | 1 | 3 |
| | 79 | 3 |

Prepared by grinding in a pebble mill for a minimum of four hours.

| Backing Formula | lbs. | ozs. |
|---|---|---|
| Ethyl Cellulose N 10LV (ex Hercules) | 12 | 0 |
| Titanium Dioxide (Rutile grade) | 0 | 4 |
| Pure Potash Blue No. 1 S.F. (ex S.C.C. Colours) | 64 | 0 |
| Toluene | 82 | 4 |

Prepared by grinding in a pebble mill for a minimum of 6 hours.

EXAMPLE 2

The coating is the same as that described in Example 1 but is applied to a polyester film (e.g. 12 micron Melinex ex I.C.I. Limited) instead of being applied to the paper sheet with the backing and barrier coatings. In this case a precoat in accordance with the following formula is applied to the pressure film to key the gelatin emulsion to the base film.

| Precoat Formula | lbs | ozs |
|---|---|---|
| Poly vinyl acetate resin (i. e. Mowlilith 50 ex Hochst) | 18 | 0 |
| Ethyl Acetate | 35 | 0 |
| Titanium Dioxide (Rutile grade) | 2 | 0 |
| Precipitated Calcium Carbonate | 20 | 0 |
| | 75 | 8 |

This precoat is prepared by grinding the constituents in a pebble mill for about four hours until a Hegman reading of 6½ - 7 is indicated.

EXAMPLE 3

| TRANSFER LAYER | | | |
|---|---|---|---|
| Part 1 | | lbs | ozs |
| | Morpholinyl leucauramine | 1 | 0 |
| | Reliance Spindle Oil S3 (ex Alexandra Cole) | 7 | 8 |
| | Titanium Dioxide (Rutile grade) | 3 | 0 |
| | Precipitated Calcium Carbonate | 11 | 0 |
| | Catafor 020 (ex Glovers Chemicals) | 0 | 4 |
| | Toluene | | |
| Part 2 | | | |
| | Toluene | 3 | 0 |
| | Vinyl Chloride Copolymer Resin VYHH (ex B.X.L.) | 6 | 4 |
| | Methyl Ethyl Ketone | 13 | 8 |
| | Ethyl Acetate | 8 | 0 |
| | | 58 | 8 |

Prepare part 1 by dissolving morpholinyl leucauramine in oil at 65° - 70° C whilst stirring. After allowing to cool, it is then loaded into a pebble mill with remainder of materials and ground overnight to a Hegman reading of 7½ - 8. The mill is unloaded and washed out with the toluene from part 2. The remainder of part 2 materials are then added whilst stirring.

Polyester Coating

This solvent formulation is applied at a coated weight of 19.5 - 21.0 g.s.m. to polyester film i.e. Melinex 12 micron ex I.C.I and does not require either a precoat or a backing.

EXAMPLE 4

The transfer sheet comprises a base sheet of paper which is a 20 grams per square meter white karbalto paper. Such paper requires to have a precoat coating to provide an adhesive layer to enable the porous coating to be bonded to the base sheet. In addition a backing coating requires to be applied to the rear of the transfer sheet to prevent oil bleed from the porous coating onto the next adjacent transfer sheet when the transfer sheets are retained in close juxtaposition in store in the autographic register.

This coating consists of:

| | | |
|---|---|---|
| Colacryl 1402 (resin) | 50 | parts by weight |
| Methyl Ethyl Ketone (solvent) | 50 | parts by weight |
| | 100 | |

Colacryl 1402 is supplied by Cole Polymers Limited as a solution 50% resin in toluene.

These backing coating constituents are mixed by high speed stirring until the resin is dissolved in the solvent. The solution is then applied to the paper by gravure application to obtain weight of 2.0 g.s.m.

A precoat coating is applied to the front face of the base sheet to serve as a receptor bonding coating for receiving the porous coating layer (to be hereinafter described). This precoat coating consists of:

| | | |
|---|---|---|
| Colacryl 1402 (resin) | 50 | parts by weight |
| Titanium Dioxide (Rutile R-HD) | 15 | parts by weight |
| Methyl Ethyl Ketone (solvent) | 35 | parts by weight |
| | 100 | |

The Titanium Dioxide helps to absorb any excess oil from the subsequent porous coating layer which otherwise would go to the surface of the porous coating layer and cause bleed.

This precoat coating is prepared by grinding in a Pebble Mill for 16 hours. The coating is then applied to the front face of the paper base sheet by gravure application to a coated weight of 2.0 g.s.m. Both the backing and the coating are supplied during the one gravure process. The porous coating layer with colour former embodied therein is formed from the following constituents:

| | | |
|---|---|---|
| Part 1 | | |
| para toluene sulphinate of Michlers Hydrol (colour former) | 2.20 | parts by weight |
| Castor Oil (dye carrier) (ex British Oil and Coke Mills) | 17.80 | parts by weight |
| Calcium Carbonate (Winnofil S from ICI) (filler) | 4.90 | parts by weight |
| Commercial Talc No. 2 (ex F. Allan) (filler or Pigment) | 9.80 | parts by weight |
| Soya Lecithin C.S.F. (ex Wynmouth Lehr) (surface active agent) | 0.94 | parts by weight |
| Toluene (diluent) | 9.80 | parts by weight |
| Washings | | |
| Toluene (diluent) | 4.60 | parts by weight |
| Methyl Ethyl Ketone (diluent) | 4.60 | parts by weight |
| Part 2 | | |
| Cellulose Acetate Butyrate ½ sec. (ex Eastman Chemicals) (resin) | 4.90 | parts by weight |
| Poly-methyl methacrylate Elvacite 2009 ex Dupont (resin) | 4.90 | parts by weight |
| Toluene (solvent for the resin) | 17.78 | parts by weight |
| Methyl Ethyl Ketone (solvent for the resin) | 17.78 | parts by weight |
| | 100.00 | |

The porous coating layer is prepared by grinding the part 1 (hereinbefore referred to) in a pebble mill for 16 hours. The mill is unloaded and the washings (also hereinbefore referred to) used to clean the mill. The constituents of Part 2 (hereinbefore referred to) are made by adding the Elvacite resin to the solvent whilst stirring and the mixture is stirred unitl the resin is dissolved. The Cellulose Acetate Butyrate resin is then added and stirred until dissolved.

Part 1 is added to Part 2 and stirred until mixed.

The porous coating layer is applied by reverse roller and scraper techniques to the precoated side of the processed paper, to a coated weight of 20 - 55 (preferably 40 - 45) grams per square meter.

It will be apparent that colour formers other than para toluene sulphinate of Michler's Hydrol can be employed, for example Morpholinyl leucauramine or Crystal Violet Lactone may be used.

Pigments or fillers other than talc may be employed, for example Titanium Dioxide or Mica may be used. However the talc or Mica is preferred because Titanium Dioxide reduces the colour intensity of the copy formed.

Colour former carriers such as Rape Seed Oil or Castor Oil or other non-drying vegetable oil or Ester Plasticisers may be employed.

The mixture of cellulose Acetate Butyrate resin and poly Methyl Methacrylate resin may be replaced by Cellulose Acetate Butyrate resin or Poly Methyl Methacrylate resin acting alone or by other acrylic resins or by vinyl chloride copolymer resin. Instead of having a porous coating embodying a colour former carbon paper of the wax based hot melt type embodying a colourless colour former or dyestuff may be employed.

Instead of having a paper base, a plastics film base can be employed.

To enable colour to be developed on the continuous stationary webs the second and succeeding sheets of the continuous stationery web assembly are coated with receptive coating to develop the colourless transfer material transferred from the transfer sheets. These receptive coatings are preferably of the acid clay or phenolic resin type. Examples of the acid clay used may be of the kind more clearly described in the specification of British patent application No. 12341/72 (Moore Business Forms Inc.). One example of acid clay coating based on a mixture of a Smectite clay and a Kaolin clay.

| Parts by Dry Weight | Ingredient |
|---|---|
| 80.00 | Acid leached Bates Hole amectite clay |
| 20.00 | Astrobrite Kaolin Clay |
| 20.00 | Acrylic latex (PGX10 Union Carbide) 47% solid |
| 5.00 | Carboxy Methyl Cellulose (Hercules 7hz) |
| 0.25 | Calgon hexametaphosphate |

The two clays are slurried for about 15 minutes with water in which the hexametaphosphate was previously dissolved. The ph of the mixture is then adjusted to 7.5 + 0.2 with a dilute solution of ammonia admixed over 30 minutes. The Carboxy Methyl Cellulose is now added as a 10% aqueous solution together with a sufficient quantity of the polymer latex (42.6 parts) to give 20 parts dry weight. Sufficient additional water is added to give a final total solids content of 35% and the entire formulation mixed for an additional 30 minutes. Storage should be under moderate agitation to prevent settling.

The clays described are adapted to ordinary coating techniques and procedures for applying conventional clay-containing coatings onto conventional record support material such as paper sheets or the like using standard coating equipment and when so applied give thin, uniform, even coatings or layers free of objectionable striations channelling or other visible defects. For ordinary purposes, it is not necessary to resort to special measures or unusual conditions in order to obtain very satisfactory coatings containing the present clays. The range of coating weights that will be found suitable for the present record materials are from about 2.0 to 12.0 grams of clay per square meter of sheet surface to be coated with 3.0 to 4.5 gm/sq.m being preferred. In the ultimate sense, the minimum limit will be that amount of clay which is necessary to provide a substantially fully coated layer of at least a single thickness of clay particles while, at the opposite extreme, larger amounts of clay can be applied, but no unusual benefit or advantage will generally be obtained as a result thereof. The coating suspension or "color" can contain about 15 - 60% by weight of clay solids, preferably about 30 - 45%. Any particle size of the clay in the normal range for paper coating will be appropriate. The clays described throughout this description all passed through a 325 mesh screen.

The inclusion of some binder material to assist in retaining the clay on the record material surface is advantageous, and the selection of a proper binder for the record sheet is somewhat more critical than in the case of the transfer sheet, as it is important to avoid binders which tend to compete with the precursor compound for the affinity of the clay. Latices of synthetic polymers are particularly useful for this purpose, such as an acrylate or a vinylacetate polymer latex. Some of these polymers may tend to develop an off-color due to the degradation on aging and should not be selected in those situations where stable coloration is an important prerequisite of the system. Continuous film-forming binders such as carboxymethyl cellulose, starch or the like can be tolerated only in small amounts and the presence of even these tend to produce some loss in the light fastness of the dye images obtained on sheets containing these materials. Fortunately, in most cases the dye images of this invention are sufficiently stable to tolerate these small losses.

In dispersing the clays of the invention to make coating compositions or for testing purposes, ammonia can be employed to good advantage without deliterious consequences on the ultimate effectiveness of the clay, since ammonia is evaporated from the record material shortly after the coating is applied. Apart from ammonia, significant amounts of dispersing assistants frequently employed in the paper-making art should be avoided, although a small amount of such dispersing agents as Carboxy Methyl Cellulose and polyphosphate salts are permissable, say up to a few percent.

What we claim is:

1. A transfer sheet assembly for use in an autographic register assembly comprising a plurality of record webs which are adapted to be fed through an autographic register and transfer sheets alternately interleaved with the record webs in the autographic register wherein the transfer sheets each comprise a base sheet selected from paper having a barrier coating and plastics film, a porous solvent coated coating on the base sheet, said porous solvent coated coating including cellulose acetate butyrate resin and polymethyl methacrylate resin and a colourless colour former within the porous coating including para toluene sulphinate of Michler's Hydrol in castor oil and wherein the record webs carry a colour developing coating for selectively developing the colour former in the porous coating.

2. A transfer sheet assembly for use in an autographic register assembly comprising a plurality of record webs which are adapted to be fed through an autographic register and transfer sheets alternately interleaved with the record webs in the autographic register wherein the transfer sheets each comprise a paper base sheet, a porous solvent coated coating on the base sheet, said porous solvent coated coating including cellulose acetate butyrate resin and polymethyl methyacrylate and a colourless colour former within the porous coating including para toluene sulphinate of Michler's Hydrol in castor oil and wherein the record webs carry a colour developing coating for selectively developing the colour former in the porous coating.

* * * * *